United States Patent [19]

Namowicz et al.

[11] Patent Number: 4,624,161

[45] Date of Patent: Nov. 25, 1986

[54] HIGH-SPEED CUTTING APPARATUS FOR CARD SHEETS

[76] Inventors: Julian Namowicz, 19175 Black Forest Dr., Waukesha, Wis. 53185; John Gengler, 19512 Washington Ave., Union Grove, Wis. 53182

[21] Appl. No.: 736,109

[22] Filed: May 20, 1985

[51] Int. Cl.[4] ..... B26D 3/22

[52] U.S. Cl. ..... 83/47; 83/283; 83/403.1; 83/408; 83/409; 83/425.3; 83/436; 83/505

[58] Field of Search ..... 83/47, 227, 262, 267, 83/283, 302, 330, 403.1, 346–348, 408, 409, 419, 425.3, 436, 505, 506; 271/245, 246, 243; 198/577, 576, 624, 783, 608

[56] References Cited

U.S. PATENT DOCUMENTS

| | | | |
|---|---|---|---|
| 2,751,981 | 6/1956 | Hawkins | 83/302 |
| 3,759,122 | 9/1973 | Lane et al. | 83/47 |
| 4,132,401 | 1/1979 | Gauronski et al. | 271/245 |

FOREIGN PATENT DOCUMENTS

| | | | |
|---|---|---|---|
| 708019 | 4/1965 | Canada | 83/302 |

*Primary Examiner*—Frank T. Yost
*Assistant Examiner*—Hien H. Phan
*Attorney, Agent, or Firm*—Peter N. Jansson

[57] ABSTRACT

A method and apparatus for high-speed and accurate cutting of cards from sheets, printed with an array of card layouts, moving along a unidirectional path. The apparatus includes rollers for initial accurate sheet feeding, a plurality of pairs of rotation members having common tangent points which serve to simultaneously advance a sheet in indexing motions and slit it along its leading edge, and a transverse cutting bar which cuts rows of cards across the slits. Each pair of rotation members includes a unidirectional driving anvil roller and an idling slitter disk. Continuous driving mechanism operates the apparatus. The apparatus for initial sheet feeding includes rollers feed sheets seriatim from a first leading-edge position to a second leading-edge position, hold them there until engaged by subsequent sheet-handling members, release them upon such engagement, and hold the next sheet in ready position while the released sheet is drawn past.

16 Claims, 11 Drawing Figures

HIGH-SPEED CUTTING APPARATUS FOR CARD SHEETS

FIELD OF THE INVENTION

This invention is related generally to the manufacture of cards, such as unfolded game cards, and, more particularly, to methods and apparatus for automatic high-speed cutting of cards from sheets of card material preprinted with an array of cards. The invention also relates to means for accurate initial feeding of sheets seriatim for subsequent handling.

BACKGROUND OF THE INVENTION

Cutting and collating small playing cards and the like from large sheets of card material preprinted to provide an array of cards is a complex and exacting task. A variety of devices and methods have been used for such task.

The known methods for cutting preprinted sheets into cards have a number of problems and disadvantages.

With some prior devices, attempts to operate at high speed have resulted in severe compromises on the accuracy of card dimensions and/or on alignment of cuts to match preprinting. With others, high accuracy of finished card dimensions and accuracy in alignment with preprinting have slowed cutting and collating operations and drastically raised the cost of production. These problems are exacerbated when a very large number of rather small cards are to be cut from large sheets.

Some examples of prior art devices and methods include diecutting of cards from a sheet. Diecutting leaves a skeleton of card stock between the cards from which the cards must be stripped. Such stripping operations are often done by hand and are a time-consuming operation. Die-cutting of cards, while generally accurate, is not particularly efficient.

Another widely used prior art method involves repetitive cutting operations with collating steps carried out between cuts. For example, a stack of large sheets, each having a large number of cards preprinted thereon sometimes with no waste material between them, may first be cut into smaller pieces with a smaller number of cards thereon, for example, in so-called "four-up" cutting. Such four-up pieces are collated with other four-up pieces until a stack is formed which is then cut into four card-sized stacks. This sort of operation can be confusing on the production floor and tend to create bottlenecks in the operation because of the many movements and steps involved.

Yet another prior method involves bi-directional movements across a sheet to produce an array of cut cards. In such operations, slitters typically move in one direction to produce a number of rows of uncut cards, which are then passed over by another set of slitters or by repetitive slitter operations. The principal problem with such devices is their complexity and the collation problems which are presented after cross-slitting is completed. Hand collation is often required. Another problem relates to inaccuracy of such cutting operations.

None of the aforementioned cutting operations lends itself to high-speed and accurate cutting of cards and to subsequent automated collation. In summary, there is a need for improved methods and apparatus for high-speed and accurate cutting of cards from sheets of preprinted card stock.

BRIEF SUMMARY OF THE INVENTION

This invention is an improved apparatus and method for high-speed and accurate cutting of cards from sheets of preprinted card stock. The invention is also an improved apparatus for initial sheet feeding to a subsequent sheet-handling device.

The apparatus for high-speed card cutting involves movement of a sheet along a path in one direction. It includes means to feed sheets seriatim from a first position and release them after their leading edges reach a second position, the feed means having means thereon to hold the next sheet in the first position while allowing the released sheet to be drawn past it. Downstream of such feed-release means are a plurality of pairs of rotation members having common tangent points at the second position for positive rolling engagement of the sheet. Each pair of rotation members includes a unidirectional driving anvil roller and an idling slitter disk having means thereon to apply disk pressure on the anvil roller through the sheet. Attached to the anvil rollers is a means to index such rollers periodically to advance the sheet by a first distance which is equal to one dimension of the finished card.

The first such indexing motion occurs after the leading edge of the card contacts the anvil rollers and slitter disks by the action of the initial feeding means. As the indexing motion begins, the release of the sheet by the initial feeding (or feed-release) means occurs. This timing assures that the sheet is properly engaged between the anvil rollers and slitters. As indexing by the anvil roller proceeds, the sheet is freely drawn through the feeding means and the next sheet is held in position to undergo initial feeding to the anvil rollers and slitters.

As such indexing motions of the the anvil roller advance the sheet, the slitters, which are stationary, slit the sheet from its leading edge. Each indexing motion lengthens the slits by an amount equal to the aforementioned first distance, that is, by an amount equal to one dimension of the card. Such indexing movement pushes the leading edge of the sheet (which is slit) beyond a cutting bar which spans the sheet transverse its path of movement. The cutting bar has a blade spaced from the second position by the first distance, and between indexing motions the knife, in one motion, simultaneously cuts a row of cards from the slit leading edge of the sheet.

These cards fall or are otherwise transported into collection bins for subsequent collating operations, if necessary, which may then be carried out readily. The collating steps do not form a part of this invention.

The apparatus of this invention includes continuous drive means to synchronize the movements of the feed means, the index means, and the cutting bar.

In certain preferred embodiments, the anvil rollers are affixed to a roller shaft which is journaled in a shaft support and the index means includes a lever arm rotatably mounted to the roller shaft through one-way clutch means. The lever arm is continuously rotated in alternate directions through a predetermined arc less than 180 degrees. The one-way clutch means engages the lever arm and shaft only when the lever arm is rotating in the advancing direction. The lever arm and shaft disengage during lever arm rotation in the opposite direction, so that the anvil rollers will not rotate in reverse.

In a highly preferred embodiment, the clutch means includes a plurality of one-way clutches in tandem to insure engagement of the lever arm with the roller shaft for substantially all rotation of the lever in the advancing direction. Also, the roller shaft, carrying the anvil rollers, is preferably journaled in the shaft support through a one-way clutch which engages the shaft when the lever arm is rotating in the direction opposite the advancing direction in order to prevent back-off rotation. Both of these features are highly desirable for extremely accurate sheet pickup from the intial feeding device.

The initial feeding device is an important aspect of this invention. In a preferred form it includes at least one pair of feed rollers, each pair including a male roller and a female roller. Preferably a number of pairs of rollers are used.

Each roller in a pair has a major peripheral portion of fixed radius such that the rollers have a common tangent line of engagement between their major peripheral portions. Such major peripheral portions provide surfaces for positive engagement with a sheet. Such major portions preferably have a surface of rubber or a similar sheet-gripping material.

Each roller also has a minor peripheral portion of lesser radius, such that a space is defined between the rollers which is sufficient for a sheet to be drawn therethrough by the downstream anvil rollers when the minor peripheral portions are facing together. Release of a sheet being moved by these rollers occurs as the major peripheral portions are disengaged at a point during the rotation of the rollers.

The male roller has means on it protruding in a generally radial direction beyond said fixed radius. When the rollers are still, the next sheet will be held in position against the protruding means ready to be fed by the motion of the rollers when they are actuated. A strip of rigid material mounted edgewise along the length of the roller at the leading edge of the major peripheral portion is an example of such a protruding member. The female roller has a recess along its length positioned to receive the protruding means when the rollers rotate.

The method of this invention includes the initial steps of holding one sheet with its leading edge in a first position and, on completing cutting of the prior sheet, positively engaging the one sheet between rollers to feed it in a first direction until the leading edge reaches a second position defined by the common tangent points of pairs of rotation members, and releasing the sheet after it is positively engaged between such pairs of rotation members.

After such initial steps, the sheet is repeatedly advanced, and slit during such advance, by means of the interaction of the pairs of rotation members, each pair having a unidirectional driving anvil roller and an idling slitter disk applying pressure on the anvil roller through the sheet. Each advance is by a predetermined distance in the first direction by means of an indexing rotation of the anvil roller. Each time the leading edge of the sheet advances to a line which is twice the predetermined distance beyond the second position, which it does in each advance except the initial advance for each sheet, the sheet is cut across the slits along a line spaced from the second position by the predetermined distance.

In a highly preferred example of the method of this invention, the initial feeding step moves sheets faster than the subsequent repetitive advancing step, such that the sheet bows with slack as the rollers feed it against the pairs of rotation members. This eliminates any looseness in engagement of the sheet between the anvil roller and slitter disk, thereby promoting accurate positioning of the sheets during the repetitive advancing steps.

The method and apparatus of this invention provide reliable and extremely accurate high-speed card cutting in a way lending itself to greatly improved efficiency of overall cutting and collating operations.

OBJECTS OF THE INVENTION

It is an object of this invention to provide a method and apparatus for high-speed cutting of cards from sheets of card material which overcome significant problems in card cutting and collating operations of the prior art.

Another object of this invention is to greatly improve the speed of card-cutting and collating operations while providing highly accurate card dimensioning.

Another object of this invention is to provide an improved card-cutting operation reducing the operational problems of scrap disposal.

Another object of this invention is to provide an improved card-cutting apparatus and method which eliminate the practice of collating intermediate multicard subsheets and the problems associated with such practice.

Another object of this invention is to provide an improved card-cutting method and apparatus avoiding manual operations.

Another object of this invention is to provide an improved card-cutting method and apparatus eliminating problems associated with the repetitive introduction of stop members in the path of sheet movement to control the accuracy of sheet movement.

Another object of this invention is to provide an improved automatic card-cutting apparatus which is relatively simple in construction.

Still another object of this invention is to provide an improved device for initial feeding of sheets seriatim into a downstream sheet-handling apparatus.

Another object of this invention is to provide a device for initial feeding of sheets which gives improved accuracy of sheet feeding.

These and other objects will be apparent from the following additional descriptions and from the drawings, wherein:

DETAILED DESCRIPTION OF PREFERRED EMBODIMENTS

Figure 1:
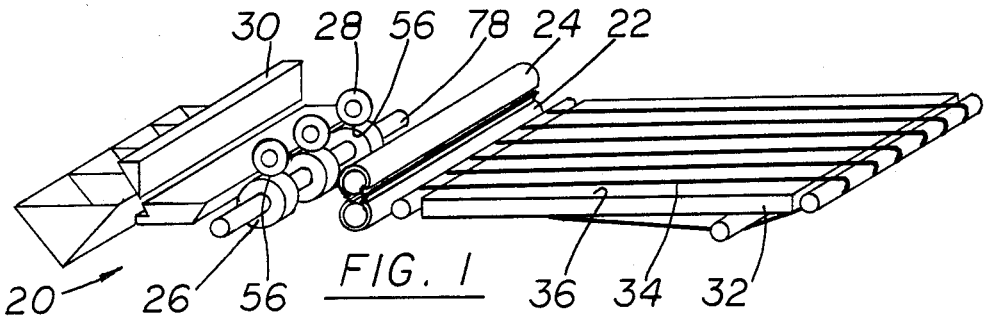
FIG. 1 is a perspective view of the sheet-contacting elements of cutting apparatus in accordance with this invention, with supporting structure removed.
Figure 2:
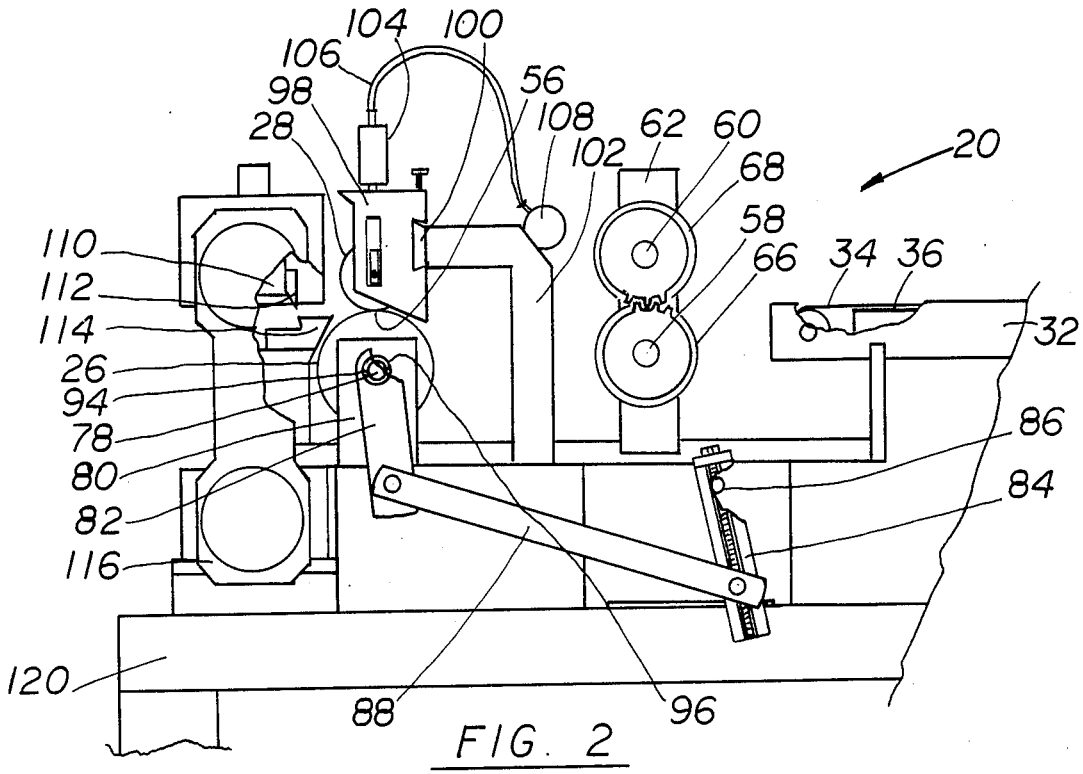
FIG. 2 is a partially cutaway fragmentary side elevation of a preferred apparatus of this invention.
Figure 3:
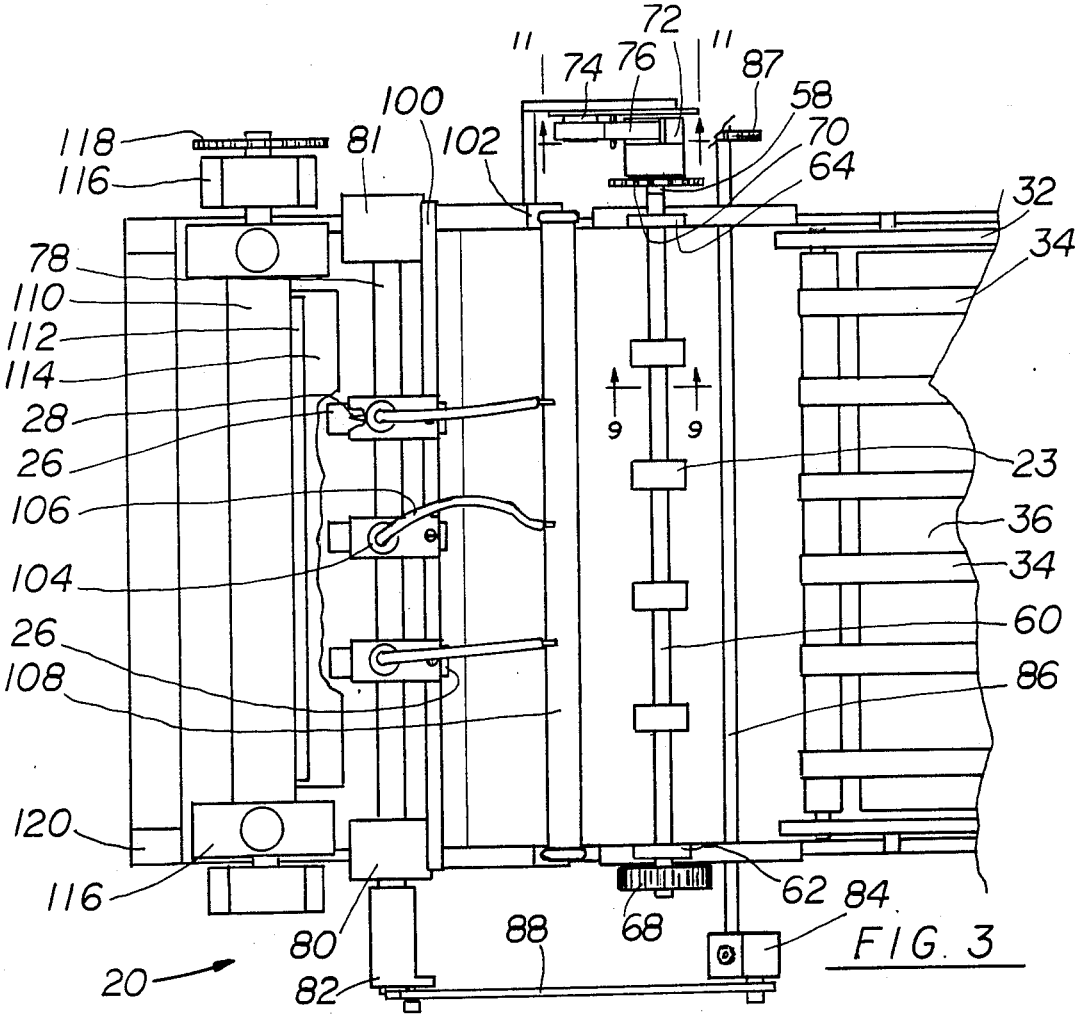
FIG. 3 is a partially cutaway top plan view of the device of FIG. 2.

FIGS. 1–3 show card-cutting apparatus 20 having a pair, or three pairs in the case of the apparatus of FIGS. 2 and 3, of parallel initial feed rollers, including a male feed roller 22 and a female feed roller 24, three pairs of anvil rollers 26 and slitter disks 28 downstream of rollers 22 and 24, and a cutting knife 30 downstream of anvil rollers 26.

Feed rollers 22 and 24 extend across the path of sheet movement, which is to the left as viewed in FIG. 1. Sheets are carried to the initial feed rollers 22 and 24 by a carrier table 32, which includes moving belts 34 extending over a table surface 36 and driven by linkage (not shown) to drive means (not shown). Carrier table 32, on which card sheets are placed seriatim by a device not shown, moves and holds each sheet against a protruding stop member 38 for subsequent initial feeding by rollers 22 and 24 to the cutting members of the apparatus.

Figure 9:
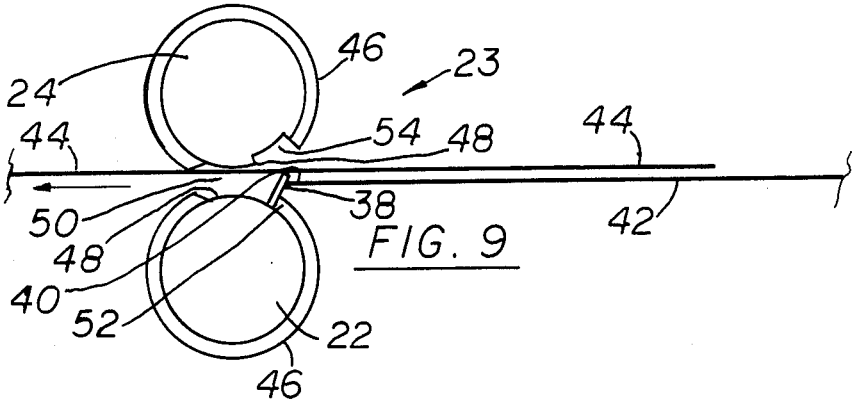
FIG. 9 is an enlarged schematic view, taken from along line 9—9 in FIG. 3, illustrating the structure and operation of the preferred initial feed rollers.
Figure 10:
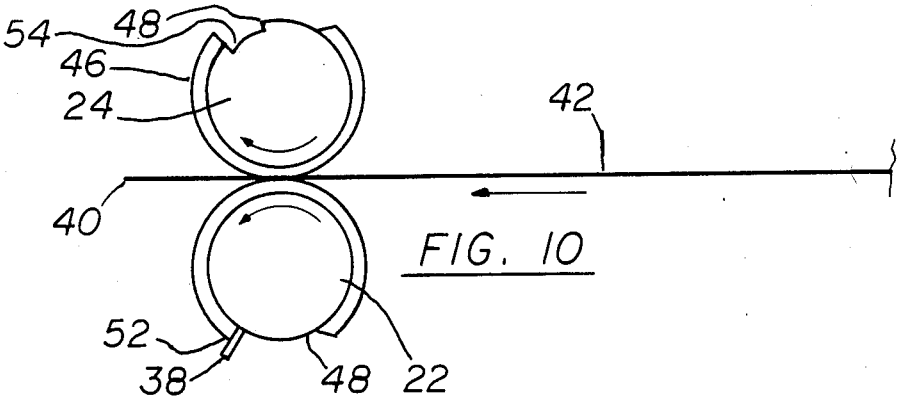
FIG. 10 is an enlarged schematic as in FIG 9, but illustrating the initial feed rollers in another position.

Protruding member 38 is shown in FIG. 1, but is best illustrated by FIGS. 9 and 10. As shown in FIG. 9, the leading edge 40 of sheet 42 engages protruding member 38 when rollers 22 and 24 are not rotating. During this time, the previous sheet 44, the leading edge of which has already been engaged by anvil rollers 26 and their respective slitter disks 28, is pulled between initial feed rollers 22 and 24 by an indexing motion, which is imparted to sheet 44 by anvil rollers 26. Such movement of sheet 44 through non-rotating rollers 22 and 24 is facilitated by the configuration of such rollers.

Rollers 22 and 24 each have a major peripheral portion 46 extending to a fixed radius. Major peripheral portions 46 of rollers 22 and 24 form a common tangent line, the point of their contact as illustrated in FIG. 10. Major peripheral portions 46 are preferably of rubber or similar material to provide positive engagement of a sheet being fed by rotation of such rollers, as shown in FIG. 10.

Rollers 22 and 24 also have minor peripheral portions 48 of lesser radius. Minor portions 48 of rollers 22 and 24 are such that, when facing one another, a space 50 is defined between rollers 22 and 24. Space 50 is sufficient to facilitate the previously-described movement of sheet 44 between rollers 22 and 24 when they are not rotating.

The junctures of the major and minor peripheral portions 46 and 48 on each roller are parallel to the axes of rollers 22 and 24. Protruding member 38 is a rigid metal strip extending in a generally radial direction beyond the fixed radius of the major peripheral portion of male roller 22 at the leading edge 52 of the major peripheral portion of male roller 22. Along female roller 24 is a recess 54, positioned to receive protruding member 38 when rollers 22 and 24 rotate.

The position of leading edge 40 against protruding member 38, prior to feeding by rollers 22 and 24, is sometimes referred to herein as a first position. When rollers 22 and 24, as positioned in FIG. 9, start to rotate, sheet 42, which continues to be loosely urged in a leftward direction by the continuing motion of carrier table 32, is positively engaged between rollers 22 and 24 and fed in a leftward direction. Such feeding, which is shown in FIG. 10, moves leading edge 40 of sheet 42 toward, and eventually to, a second position which is defined by the aligned common tangent points of the pairs of anvil rollers 26 and slitter disks 28.

The feeding by rollers 22 and 24 moves sheet 42 faster than its subsequent movements between anvil rollers 26 and slitter disks 28. As rollers feed sheet 42 against common tangent points 56, sheet 42 bows slightly with slack. This promotes accurate initial sheet engagement by anvil rollers 26 and slitter disks 28, and thus promotes excellent control of the sheets during subsequent slitting and cutting operations.

After anvil rollers 26 and slitters 28 engage a sheet, the indexing motions of anvil rollers 26 control the sheet movement. Rollers 22 and 24 do not rotate until another sheet must undergo intial feeding. However, the sheets, such as sheet 44 shown in FIG. 9, are pulled through space 50.

As shown in FIGS. 2 and 3, a number of pairs 23 of rollers 22 and 24 are mounted on shafts 58 and 60, respectively, which are journaled in supports 62 and 64 on opposing sides of the path of sheet movement. Rollers 22 and 24 rotate in coordinated fashion by virtue of gears 66 and 68 which are keyed to shafts 58 and 60, respectively.

Figure 11:
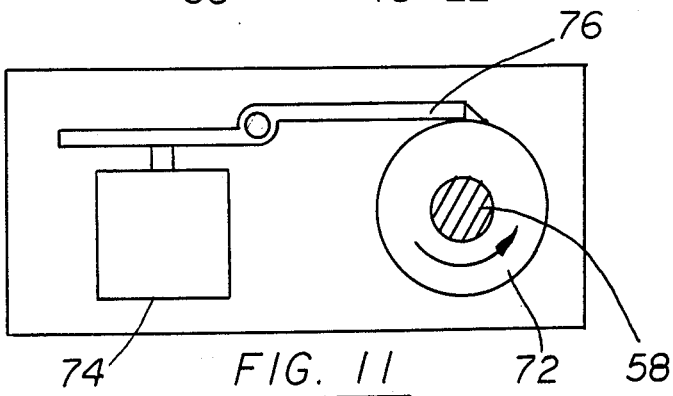
FIG. 11 is an enlarged sectional view taken along section 11—11 as shown in FIG. 3.

A sprocket 70, rotatably mounted on shaft 58, is periodically engagable with shaft 58 through a wrapped-spring single-revolution clutch 72, shown in FIG. 3 and best illustrated in FIG. 11. A Warner clutch is an example of a suitable wrapped-spring single-revolution clutch. Sprocket 70 is continuously driven in one direction by chain means (not shown) linking it to the drive means for apparatus 20. The actuation of rollers 22 and 24 is controlled by a spring-loaded tripping mechanism 74 which counts the indexing motions of anvil rollers 26 and, at the appropriate time, causes movement of a trigger arm 76 to actuate engagement of the clutch. After one complete rotation, clutch 72 disengages sprocket 70 from shaft 58, and the pairs 23 of rollers 22 and 24 remain still until subsequent actuation.

As shown in FIGS. 1–4, anvil rollers 26 are affixed to a roller shaft 78 which is journaled at either end in upright supports 80 and 81 fixed on opposite sides of the path of sheet travel through apparatus 20. A lever arm 82 is rotatably mounted on roller shaft 78 at one side of apparatus 20.

As best illustrated in the schematic drawings of FIGS. 5–8, lever arm 82 is rotated continuously in alternate directions by a continuous drive means. Such drive means includes an adjustable drive arm 84, which is keyed to a drive shaft 86, and a link arm 88 which is rotatably connected to lever arm 82 and drive arm 84. Drive shaft 86 and drive arm 84 rotate continously in a clockwise direction (as viewed in FIGS. 2 and 5–8), being driven by a main drive means (not shown) through chains (not shown) engaging a sprocket 87.

The alternating of rotational direction of lever arm 82 is by virtue of the arrangement and relative functional lengths of lever arm 82, drive arm 84, and link arm 88, as well as the spacing between the axes of roller shaft 78 and drive shaft 86. Such rotation, which is through an arc less than 180 degrees, requires the combined functional lengths of lever arm 82 and link arm 88 to be less than the spacing between roller shaft 78 and drive shaft 86 combined with the length of drive arm 84.

By various adjustments in these lengths and spacings, the arc of travel of lever arm 82 can be increased or decreased to suit the requirements of the job at hand. Convenient adjustment can be made by adjusting the length of drive arm 84, which is made adjustable for that purpose. And, using anvil rollers having differing diameters also changes the degree of linear travel of a sheet advanced by anvil rollers 26.

Figure 4:
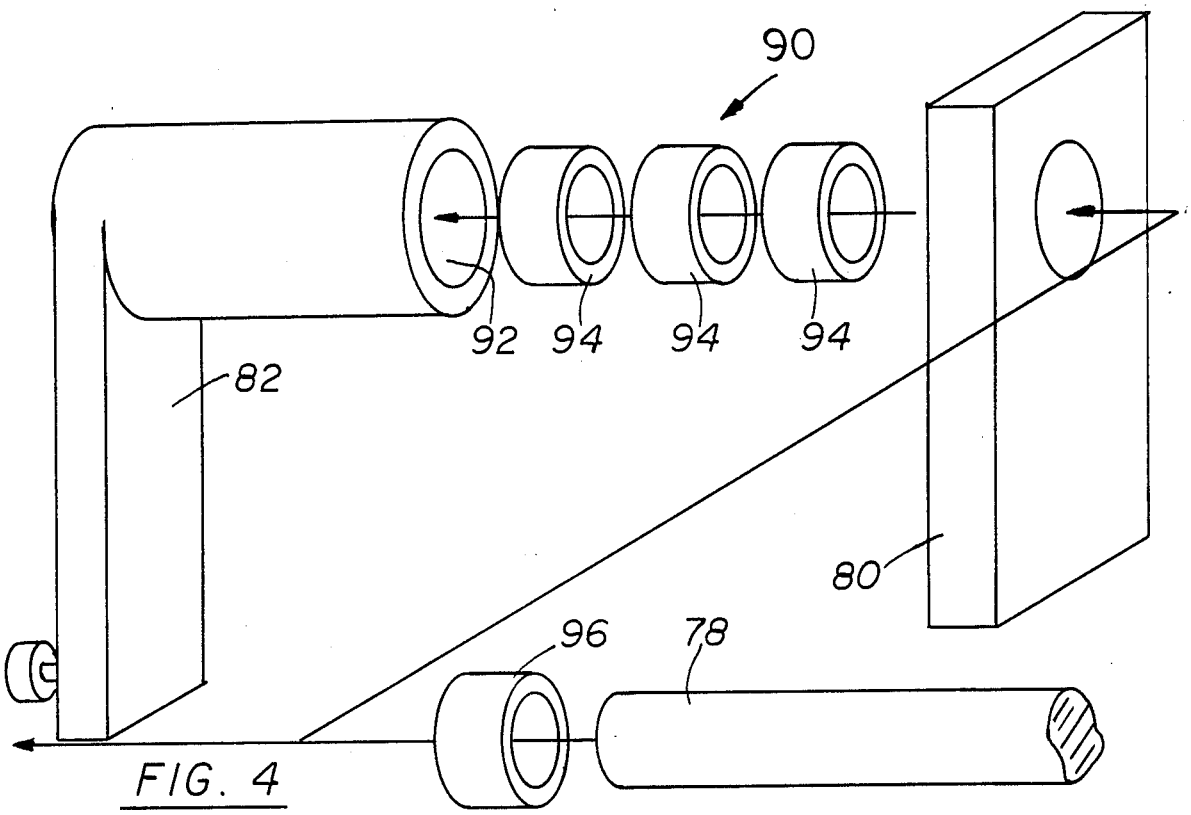
FIG. 4 is an enlarged exploded perspective view of key portions of the device shown in FIGS. 2 and 3 for driving the anvil roller in one direction.

The unidirectional rotation of anvil rollers 26, shown in FIGS. 5–8, is obtained by the use of a one-way clutch means 90, which is shown in FIGS. 2–4 and best illustrated in FIG. 4. Formed in lever arm 82 is a cylindrical bore 92 which is aligned to receive roller shaft 78 and three one-way roller clutches 94 sleeved over roller shaft 78 in tandem. Suitable one-way clutches are available from Torrington Company of Torrington, CT.

Figure 5:
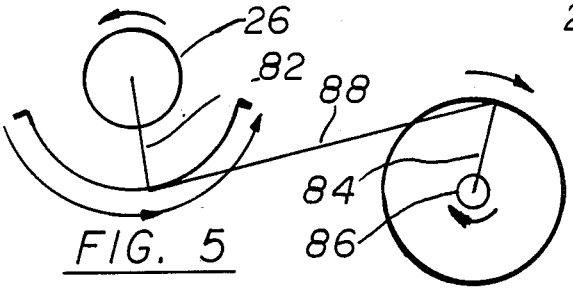
FIGS. 5–8 are a series of schematic drawings showing the continuous motion of the lever arm of FIG. 4.
Figure 6:
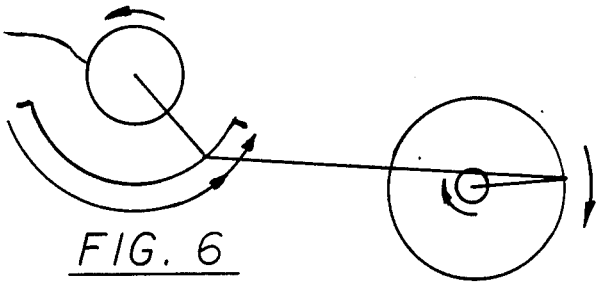
Figure 7:
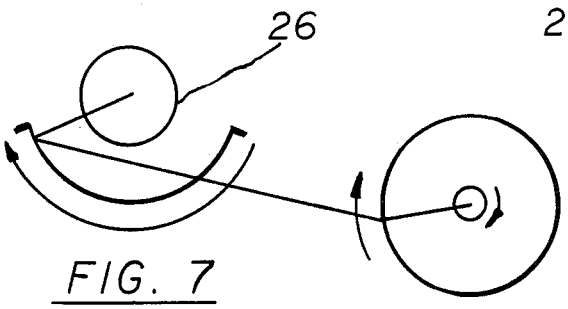
Figure 8:
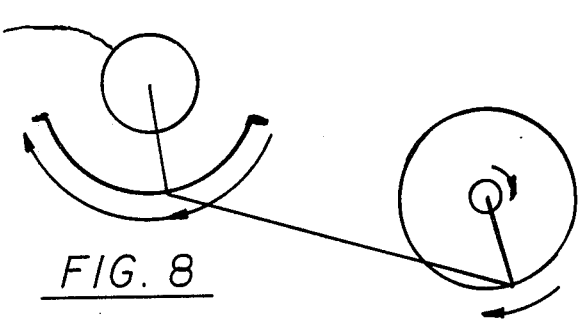

One-way roller clutches 94 serve to engage lever arm 82 and roller shaft 78 only when lever arm 82 is rotating in the sheet-advancing direction, as illustrated by FIGS. 5 and 6. When the lever arm is rotating in the opposite direction, as illustrated by FIGS. 7 and 8, roller clutches 94 disengage lever arm 82 from roller shaft 78 so that anvil rollers 26 do not rotate in either direction. By using a plurality of one-way clutches in tandem, engagement of lever arm 82 with roller shaft 78 is insured for substantially all rotation of lever arm 82 in the advancing direction.

As shown in FIGS. 2 and 4, roller shaft 78 is journaled in upright support 80 through another one-way roller clutch 96 which is used to insure that there will be no back-off rotation of shaft 78 when lever arm 82 is rotating in the non-advancing direction illustrated in FIGS. 7 and 8. Such anti-back off (or "back-stopping") clutches may be used at one end or at both ends of roller shaft 78.

Mounted above each anvil roller 26 is a slitter disk 28. Slitter disks 28 are idling rotation members. As illustrated in FIGS. 2 and 3, idling slitter disks 28 are part of separate slitter assemblies 98 which are mounted on a mounting bar 100 supported by uprights 102 and extending across the path of sheet travel. By such mounting means, each idling slitter disk 28 is supported above and in alignment with an anvil roller 26.

Slitter assemblies 98 also include air cylinders 104 to drive slitter disks 28 against the hard cylindrical surfaces of anvil rollers 26 with generally constant pressure. Avoiding substantial pressure variations facilitates the control of sheets being advanced and slit between idling slitter rollers 29 and anvil rollers 26. Air pressure is provided to cylinders 104 through tubes 106 connected to a manifold pipe 108, which is secured to uprights 102. Individual pressure reading and adjustment devices may be secured to each air line, preferably along manifold pipe 108, to individually adjust the pressure of each slitter disk on its corresponding anvil roller.

Each anvil roller 26 is engaged with its corresponding slitter disk 28 at a common tangent point. When there are a plurality of pairs of anvil rollers and slitter disks, the common tangent points are along a single line. The common tangent points define the aforementioned second position.

Sheets between anvil rollers 26 and slitter disks 28 are positively engaged by them such that they will be accurately advanced and, during such advance, be properly slit. In each indexing movement of anvil rollers 26, a sheet engaged by anvil rollers 26 is advanced a predetermined distance which is equal to one dimension of the cards being cut from the sheet.

As illustrated in FIGS. 1–3, a cutting bar 110 extends across the path of sheet travel at a right angle thereto. Cutting bar 110 includes a blade 112 along its length over the path of sheet travel. Blade 112 is spaced downstream of the second position by a distance equal to the predetermined distance. When the leading edge of a sheet reaches a position beyond the second position (that is, beyond the common tangent points on anvil rollers 26) which is twice the predetermined distance, then the sheet is cut, across the slits, along a line spaced from the second position by the predetermined distance.

Such transverse cut is accomplished by downward motion of cutting bar 110 and its blade 112. In such downward motion, blade 112 passes (in cutting action) a cooperating cutting member 114 which is mounted in fixed position. The downward motion of cutting bar 110 is accomplished by the action of Pitman arms 116, shown in FIGS. 2 and 3, in well-known fashion requiring no description. Pitman arms 116 are driven by chain means (not shown) engaging sprocket 118.

After cutting by cutting bar 110, the cards will be received into receptacles, as illustrated simply in FIG. 1. As previously noted, the collection and subsequent collation are not part of this invention.

As is apparent, the various elements of this invention and supporting apparatus are attached to an apparatus frame 120, as illustrated in FIGS. 2 and 3. A variety of suitable mounting frames would be apparent to those skilled in the art.

For ease of illustration, only three driving anvil rollers 26 and three slitter disks 28 were shown in the drawings. Most card-cutting operations of the type for which the apparatus and method of this invention are intended will require several more pairs of such devices, in many cases ten or more. Anvil rollers 26 can be spaced along roller shaft 78 as required for the intended operation. Similarly, the required number of slitter assemblies 98 can be placed as required along mounting bar 100. The spacing of the pairs of anvil rollers and slitter disks, of course, determines one of the dimensions of the cards being cut from the sheets.

The apparatus of this invention can be made using available materials. Appropriate parts and materials would be apparent to those skilled in the art. Anvil rollers 26 are preferably made of hardened tool steel. Disks for slitting various kinds of materials are commercially available.

While in the foregoing specification the apparatus and method of this invention have been described in relation to certain preferred embodiments, and many details have been set forth for purposes of illustration, it will be apparent to those skilled in the art that the invention is susceptible to additional embodiments and that certain of the details described herein can be varied considerably without departing from the spirit of the invention.

What is claimed is:

1. A method for accurate high-speed cutting of cards from sheets comprising:

holding one sheet, its leading edge in a first position;

on completing prior sheet cutting, positively engaging the one sheet between rollers to feed it in a first direction and releasing it after its leading edge reaches a second position;

starting before the releasing step, positively engaging the sheet between a plurality of pairs of rotation members having common tangent points at the second position, each pair having a unidirectional driving anvil roller and an idling slitter disk applying pressure on the anvil roller through the sheet;

advancing and simultaneously slitting the sheet a predetermined distance in the first direction by an indexing rotation of the anvil roller until the leading edge is twice the predetermined distance beyond the second position;

cutting the sheet across the slits along a line spaced from the second position by the predetermined distance; and repeating the advancing and cutting steps until completing cutting of the sheet into cards.

2. The method of claim 1 wherein the feeding step moves sheets faster than the advancing step, such that the sheet bows with slack as the rollers feed it against the pairs of rotation members, thereby promoting accurate feeding of the sheets to the rotation members.

3. The method of claim 2 wherein the advancing step comprises:

continuously rotating a lever arm in alternate directions through a predetermined arc less than 180 degrees;

engaging the lever arm with a shaft to which the anvil rollers are affixed when the lever arm is rotating in the advancing direction; and disengaging the lever arm from the shaft when the lever arm is rotating in the opposite direction.

4. Apparatus for high-speed cutting of cards from sheets moving along a path comprising:

means to feed sheets seriatim from a first position and release them after their leading edges reach a second position, the feed means having means thereon to hold the next sheet in the first position while allowing the released sheet to be drawn by;

a plurality of pairs of rotation members having common tangent points at the second position for positive rolling engagement of the sheet, each pair including a unidirectional driving anvil roller and an idling slitter disk having means thereon to apply disk pressure on the anvil roller through the sheet;

means to index the anvil roller(s) periodically to advance the sheet by a first distance, said release means operating during advancing movement of the index means;

a cutting bar transverse the path and having a blade spaced from the second position by the first distance; and continuous drive means to synchronize the movements of the feed means, the index means, and the cutting bar.

5. The apparatus of claim 4 wherein:

the anvil rollers are affixed to a roller shaft which is journaled in a shaft support; and the index means comprises a lever arm linked for continuous rotation in alternate directions through a predetermined arc less than 180 degrees, said lever arm being rotatably mounted to the roller shaft through one-way clutch means engaging the lever arm and shaft only when the shaft is rotating in the advancing direction.

6. The apparatus of claim 5 wherein the roller shaft is journaled in the shaft support through a one-way clutch engaging the shaft to prevent back-off rotation when the lever arm is rotating in the reverse of the advancing direction.

7. The apparatus of claim 5 wherein the one-way clutch means includes a plurality of one-way clutches to insure engagement of the lever arm with the roller shaft for substantially all rotation of the lever arm in the advancing direction.

8. The apparatus of claim 7 wherein the roller shaft is journaled in the shaft support through a one-way clutch engaging the shaft to prevent back-off rotation when the lever arm is rotating in the reverse of the advancing direction.

9. The apparatus of claim 4 wherein the feed-release means comprises:

at least one pair of feed rollers, each pair including a male roller and a female roller;

each roller having: a major peripheral portion of fixed radius such that the rollers have a common tangent line of engagement between their major peripheral portions, such major peripheral portions providing surfaces for positive engagement with a sheet; and a minor peripheral portion of lesser radius, such that a space is defined between the rollers sufficient for a sheet to be drawn therethrough by the anvil rollers when the minor peripheral portions are facing together, said sheet release occurring by disengagement of the major peripheral portions; and said hold means including: means on the the male roller protruding in a generally radial direction beyond said fixed radius, said female roller having a recess to receive the protruding means when the rollers rotate; and stop means preventing rotation of the rollers until actuated.

10. The apparatus of claim 9 wherein there are a plurality of pairs of feed rollers.

11. The apparatus of claim 10 wherein:

the anvil rollers are affixed to a roller shaft which is journaled in a shaft support; and the index means comprises a lever arm linked for continuous rotation in alternate directions through a predetermined arc less than 180 degrees, said lever arm being rotatably mounted to the roller shaft through one-way clutch means engaging the lever arm and shaft only when the shaft is rotating in the advancing direction.

12. The apparatus of claim 11 wherein the roller shaft is journaled in the shaft support through a one-way clutch engaging the shaft to prevent back-off rotation when the lever arm is rotating in the reverse of the advancing direction.

13. The apparatus of claim 11 wherein the one-way clutch means includes a plurality of one-way clutches to insure engagement of the lever arm with the roller shaft for substantially all rotation of the lever arm in the advancing direction.

14. The apparatus of claim 13 wherein the roller shaft is journaled in the shaft support through a one-way clutch engaging the shaft to prevent back-off rotation when the lever arm is rotating in the reverse of the advancing direction.

15. Apparatus for accurate initial feeding of sheets seriatim to a downstream sheet-handling device comprising:

at least one pair of rollers, each pair including a male roller and a female roller;

each roller having (a) a major peripheral portion of fixed radius forming a common tangent line of engagement between the major peripheral portions of the rollers, such major peripheral portions providing surfaces for positive engagement with a sheet, and (b) a minor peripheral portion of lesser radius, whereby a space is defined between the rollers sufficient for a sheet to be drawn therethrough by the downstream sheet-handling device when the minor peripheral portions are facing together;

means on the the male roller protruding in a generally radial direction beyond said fixed radius;

recess means on the female roller positioned to receive the protruding means when the rollers rotate;

drive means including means to rotate the rollers in opposing directions for sheet feeding; and stop means preventing rotation of the rollers until the drive means is actuated.

16. The apparatus of claim 15 wherein there are a plurality of axially aligned pairs of feed rollers.

* * * * *